US009326625B1

(12) United States Patent
Esfahani

(10) Patent No.: US 9,326,625 B1
(45) Date of Patent: May 3, 2016

(54) FLIPTOP MATEABLE PLATES APPARATUS

(71) Applicant: Shahein Esfahani, Orlando, FL (US)

(72) Inventor: Shahein Esfahani, Orlando, FL (US)

( * ) Notice: Subject to any disclaimer, the term of this patent is extended or adjusted under 35 U.S.C. 154(b) by 0 days.

(21) Appl. No.: 14/874,472

(22) Filed: Oct. 5, 2015

(51) Int. Cl.
*B65D 6/28* (2006.01)
*A47G 19/02* (2006.01)
*B65D 21/02* (2006.01)

(52) U.S. Cl.
CPC ..... *A47G 19/02* (2013.01); *B65D 21/0228* (2013.01)

(58) Field of Classification Search
CPC ..... B65D 11/188; B65D 21/0224; B65D 21/0234; B65D 11/1886; B65D 11/02; A47G 19/027
See application file for complete search history.

(56) References Cited

U.S. PATENT DOCUMENTS 3,473,649 A * 10/1969 Posso ..... G03B 21/323 206/404
3,933,295 A 1/1976 Congleton
3,938,726 A 2/1976 Holden, Jr. et al.
5,273,174 A 12/1993 Fisher
8,146,762 B2 4/2012 Leoncavallo et al.

* cited by examiner

*Primary Examiner* — Jeffrey Allen
(74) *Attorney, Agent, or Firm* — Paul Royal, Jr.; The Patent Guild

(57) ABSTRACT

The present fliptop plates apparatus relates generally to a mateable plate apparatus and more particularly to an improved plate apparatus comprising a working surface of a first plate which complimentarily and lockingly can be mated with a working surface of a companion plate to form a receptacle, wherein preferably both plates have identical working surfaces, the plates may provide tactile feedback to users of the mateable plate apparatus, and the plates may be easily and optimally both stacked and unstacked.

4 Claims, 11 Drawing Sheets

FLIPTOP MATEABLE PLATES APPARATUS

FIELD OF THE APPARATUS

The present fliptop mateable plates apparatus relates generally to a mateable plate apparatus and more particularly to an improved plate apparatus comprising a working surface of a first plate which complimentarily and lockingly can be mated with a working surface of a companion plate to form a receptacle, wherein preferably both plates have identical working surfaces, the plates may provide tactile feedback to users of the mateable plate apparatus, and the plates may be easily and optimally both stacked and unstacked.

BACKGROUND OF THE INVENTION

Conventional containers and receptacles are formed of at least one item which provides the main container or receptacle and a different shaped structure or container provides the cover or lid for the main container. The interface between the main container or receptacle cover or lid for the main container most often presents complimentary yet dissimilar structures.

Further, plates typically can serve as a main container or receptacle or as a cover or lid for the main container or receptacle.

What is needed however is a mateable plate apparatus comprised essentially of identical plates which complimentarily and lockingly can be mated together. The identical plates can therefore function as either the cover/lid or the main container.

Relevant patents are presented here, however reference to, and discussion of, the following patents is intended to aid in discharging Applicant's acknowledged duty of candor in disclosing information that may be relevant to the examination of claims to the present apparatus. However, it is respectfully submitted that none of the above-indicated patents disclose, teach, suggest, show, or otherwise render obvious, either singly or when considered in combination, the apparatus described and claimed herein.

U.S. Pat. No. 3,933,295 teaches packaging device forming an insulative structure for hot food sandwiches. The packaging device includes a pair of identical members, which when interconnected, form an insulative food container.

U.S. Pat. No. 3,938,726 teaches an integral tray structure of expanded substantially rigid plastic foam material, typically polystyrene foam is formed to have a bottom plate surface, an upstanding surrounding, inclined rim and a laterally projecting flange formed on the rim, the flange having, around its periphery, spaced projections, and recess means which are so arranged that, upon inversion of a tray structure above another tray structure, a hollow, insulated chamber, to contain hot or cold food, is formed.

U.S. Pat. No. 5,273,174 teaches two substantially identical tray members cooperate to define an enclosed space for a pizza pie or the like, each having a circular base wall, a frusto-conical side wall and an annular flange.

U.S. Pat. No. 8,146,762 teaches a container for a flexible bag of liquid that supports the bag during transportation, storage and use in dispensing of the liquid.

SUMMARY OF THE APPARATUS

It is therefore an object of the present invention/apparatus to provide an improved plate apparatus comprising a working surface of a first plate which complimentarily and lockingly can be mated with a working surface of a companion plate to form a receptacle, wherein preferably both plates have identical working surfaces, the plates may provide tactile feedback to users of the mateable plate apparatus, and the plates may be easily and optimally both stacked and unstacked.

Other novel features which are characteristic of the apparatus, as to organization and method of operation, together with further objects and advantages thereof will be better understood from the following description considered in connection with the accompanying figures, in which preferred embodiments of the apparatus are illustrated by way of example. It is to be expressly understood, however, that the figures are for illustration and description only and is not intended as a definition of the limits of the apparatus. The various features of novelty which characterize the apparatus are pointed out with particularity in the claims annexed to and forming part of this disclosure. The apparatus resides not in any one of these features taken alone, but rather in the particular combination of all of its structures for the functions specified.

There has thus been broadly outlined the more important features of the apparatus in order that the detailed description thereof that follows may be better understood, and in order that the present contribution to the art may be better appreciated. There are, of course, additional features of the apparatus that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present apparatus. It is important, therefore, that the claims be regarded as including such equivalent constructions insofar as they do not depart from the spirit and scope of the present apparatus.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the apparatus of this application, which is measured by the claims, nor is it intended to be limiting as to the scope of the apparatus in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The apparatus will be better understood and objects other than those set forth above will become apparent when consideration is given to the following detailed description thereof. Such description makes reference to the annexed drawings, wherein.

DETAILED DESCRIPTION OF THE EMBODIMENTS

The present invention is a mateable plate apparatus 100 as shown in the embodiments in FIG. 1A thru FIG. 4G. The mateable plate apparatus 100 provides a pair of identical plates 200 that complimentarily mate with each other. Embodiments are provided herein which further provide a variety of mating configurations for mateable plates having identical halves such as wherein the invention may further include a protrusion, and/or a slot, and/or a locking dimple.

Figure 1A:
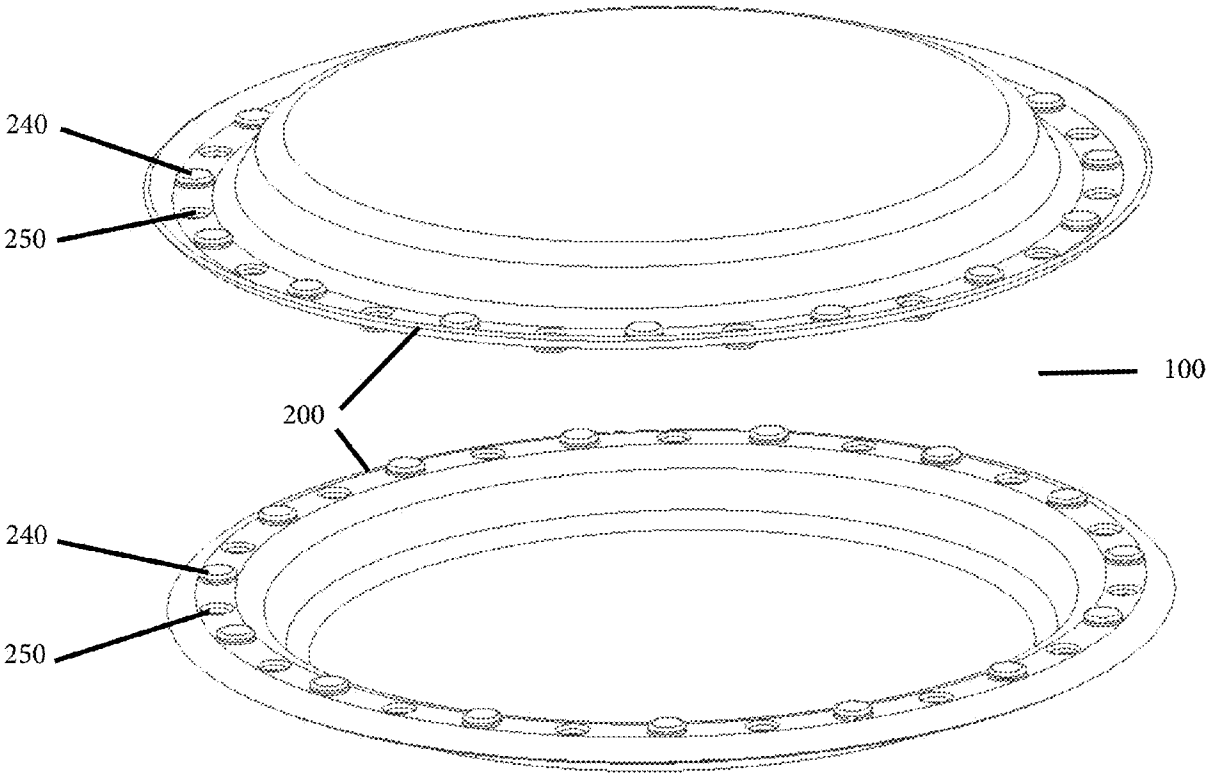
FIG. 1A is a perspective view of the mateable plates having identical halves.
Figure 1B:
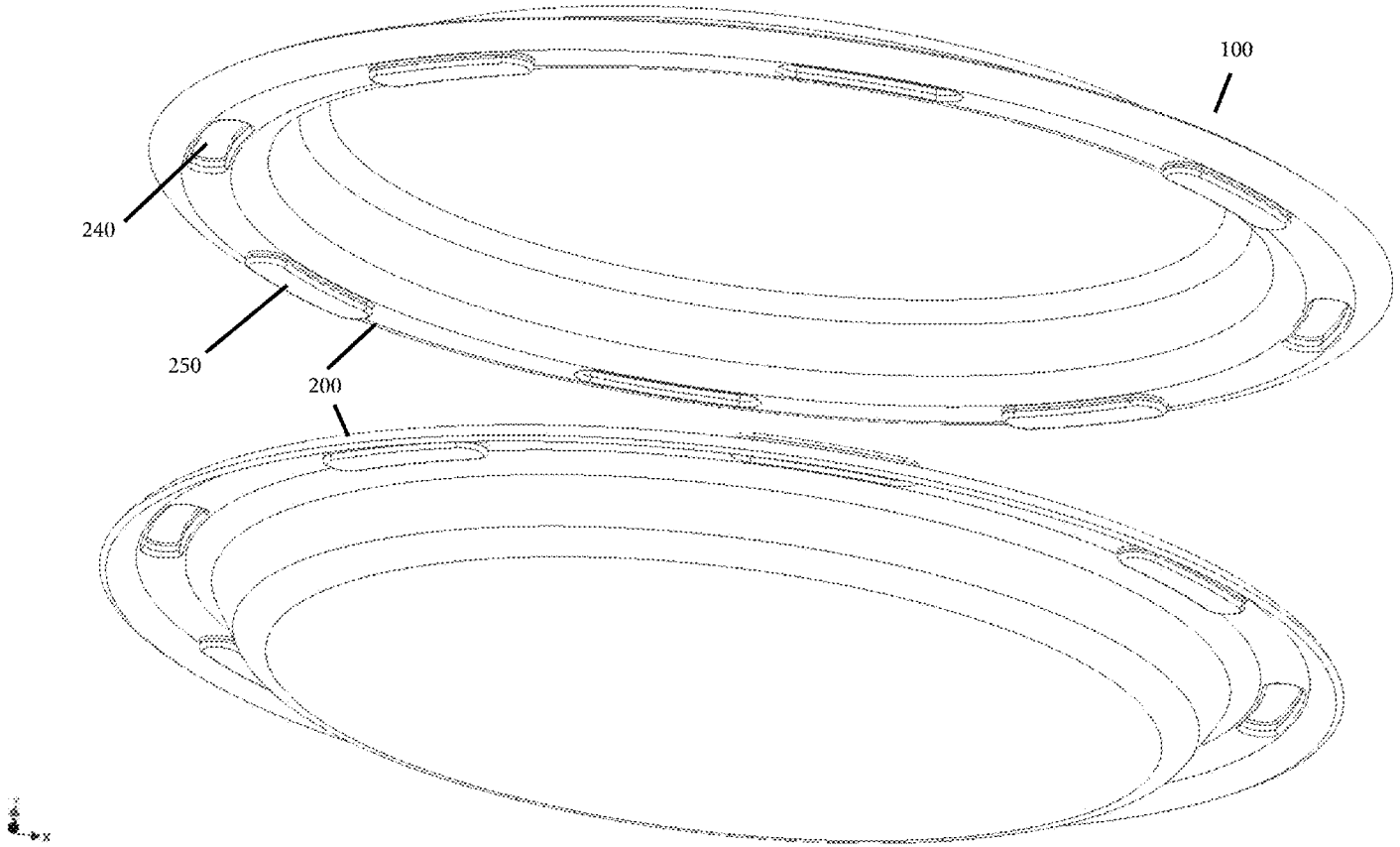
FIG. 1B is a perspective view of the mateable plates having identical halves.

Specifically, as shown in FIG. 1A and FIG. 1B, the mateable plate apparatus 100 is comprised of a pair of identical plates 200 which include structures that allow the plates to securely fit together. Further the pair identical plates 200 can be unlocked and separated from each other without damaging either plate.

Note—It is understood the elements of the instant invention are composed of similar or different material and one element may yield or deform (temporarily or permanently).

Figure 2A:
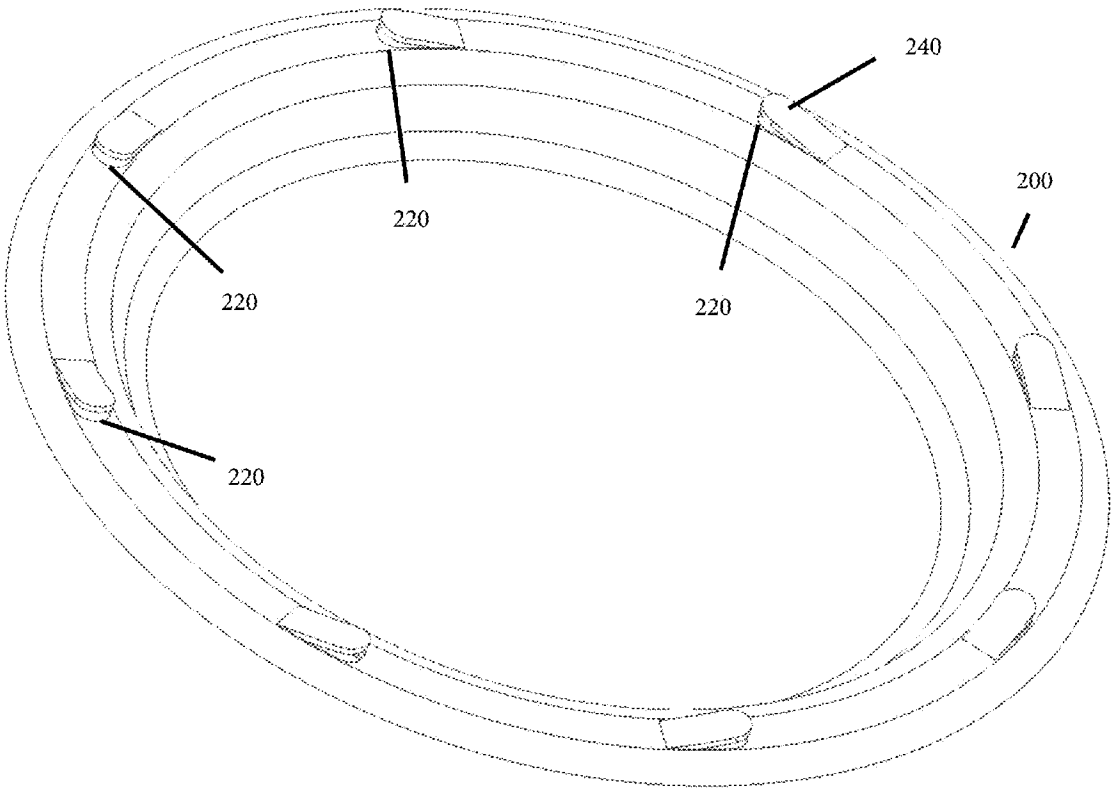
FIG. 2A is a perspective view of a plate having a protrusion and slot.

As shown in FIG. 2A, the plate 200 may include, among other features, a protrusion 240 and slot 220.

Figure 3A:
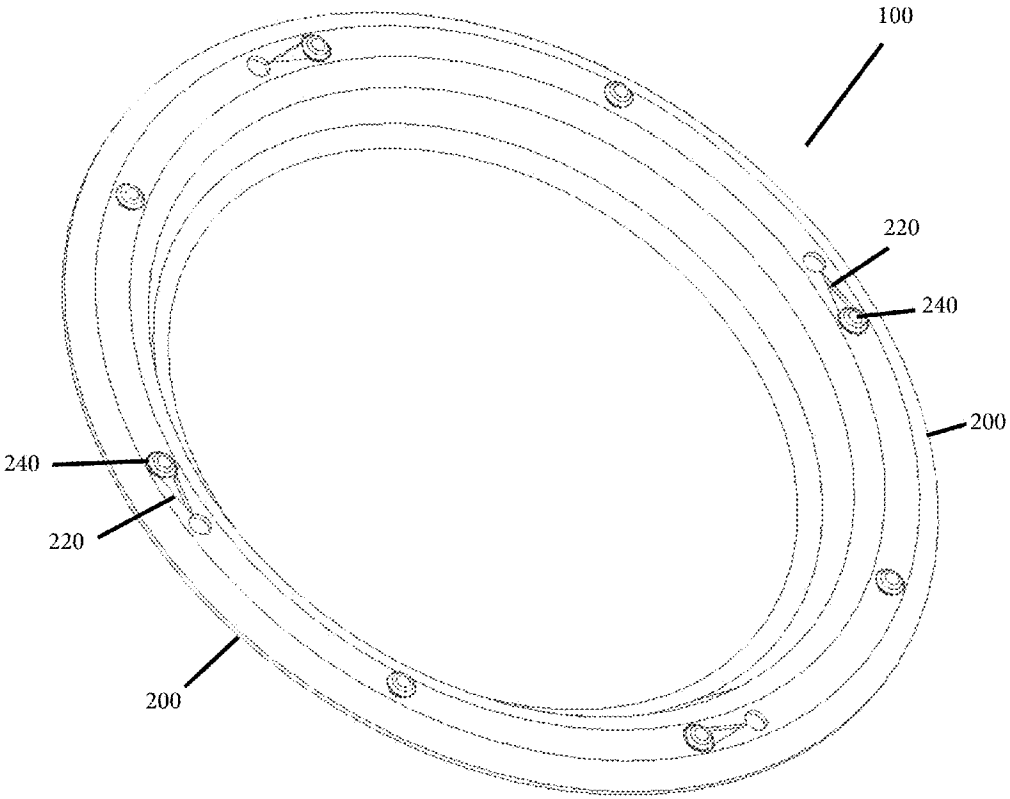
FIG. 3A is a perspective view of a plate having a protrusion and slot.

As shown in FIG. 3A, the plate 200 may include, among other features, a protrusion 240 and shaped slot 220.

As shown in FIG. 4A thru FIG. 4G, the plate 200 may include, among other features, a protrusion 240, shaped slot 220 and a locking dimple 250.

Plate Structure Applicable to Both Plates

Within each embodiment each plate 200 of the mateable plate apparatus 100 is identical therefore it is understood the below description is application to both plates of the embodiment under review.

In the preferred embodiment shown in FIG. 4A thru FIG. 4G, the plate 200 may include, among other features, a protrusion 240, shaped slot 220, and a locking dimple 250.

More particularly, each plate 200 includes a circumferential plate rim 205, a plate side wall 210 extending from the plate rim 205, and a plate bottom 215 forming an enclosure of the side wall 210.

Each plate rim 205 includes at least one positioning channel 220, the positioning channel including a slot 221, a first opening 225 provided at a proximal end of the slot 221, and a second opening 230 provided at a distal end of the slot 221, wherein the slot 221 interconnects the first opening 225 and the second opening 230. As provided in the preferred embodiment the first opening 225 and the second opening 230 are dissimilar sizes however it is understood they could also be of the same size. Further while the preferred embodiment shows the slot 221 having a generally even rectangular shape, it is understood the slot 221 could have alternate shapes including a triangular shape, an "S" shape, a sinusoidal shape, a jagged shape, a spiral shape, or a combination of similar or different shapes.

The circumferential plate rim 205 includes a top surface 206 and a bottom surface 207 and the at least one positioning channel 220 extends completely through both the circumferential plate rim top surface 206 and the circumferential plate rim bottom surface 207.

A positioning protrusion 240 is provided on the plate rim top surface 206. The positioning protrusion 240 includes a protrusion base 241 which attaches the positioning protrusion 240 to the plate rim top surface 206 and a protrusion head 242 positioned atop the protrusion base 241, the protrusion head further including an outer periphery 243.

The protrusion head 242 can be of varying shapes selected from the group comprising at least: star, crescent, diamond, triangle, circular, pyramid, circular, spherical, elongated, rectangle, iconic—such as vegetable, foods, nuts, means, characters, and other indicia.

A locking dimple 250 is provided on the circumferential plate rim bottom surface 207 approximate the circumferential plate first opening 225, the locking dimple further including an outer periphery 251.

The protrusion base 241 is sized to be approximately equal or smaller than the protrusion head 242. Both the protrusion head 242 and the protrusion base 241 (singularly or collectively) may be of a single consistent diameter or they may be comprised of varying diameters.

The positioning protrusion 240 of each identical plate 200 is sized and configured to cooperatively fit within the at least one positioning channel 220 of the companion plate 200 as further discussed below.

As shown in the preferred embodiment, the positioning protrusion head 242 is sized to be small enough to be inserted into the positioning channel second opening 230 with little or no contact with the second opening 230. The protrusion base 241 is also is sized to be small enough to be inserted into the positioning channel second opening 230 with little or no contact with the second opening 230.

The protrusion base 241 is sized to be small enough to be inserted into the positioning channel slot 220 with little or no contact with the positioning channel slot 220.

The positioning protrusion head 242 is sized to be larger than the positioning channel slot 220 thereby preventing the positioning protrusion head 242 from passing completely thru the positioning channel slot 220.

Further as shown in the preferred embodiment, the positioning protrusion head 242 is sized to be larger than the positioning channel first opening 225 thereby preventing the positioning protrusion head 242 from passing completely thru the positioning channel first opening 225.

The protrusion base 241 is sized to be small enough to be inserted into the positioning channel first opening 225 with little or no contact with the first opening 225.

The positioning protrusion 240 is sized so that when fully seated within the positioning channel first opening 225 of the companion plate 200, the positioning protrusion head 242 is positioned approximate the locking dimple 250 provided on the circumferential plate rim bottom surface 207 of the companion plate 200. The positioning protrusions head outer periphery 243 may slightly abut the companion plate locking dimple 250 or may be clear of the companion plate locking dimple 250.

The protrusion base 241 of each plate 200 is sized to allow the positioning protrusion 240 to be translated thru the plate rim slot 221 with minimal or no contact with the locking dimple 250 of the companion plate 200.

The positioning protrusion head 242 of a first plate is sized to provide yielding resistance to the translation of the positioning protrusion 240 when the positioning protrusion head 242 is abutting the locking dimple 250 of the companion plate 200. The resistance to the translation of the positioning protrusion head 242 diminishes as the positioning protrusion head 242 moves past the locking dimple 250 of the companion plate 200.

During translation of the positioning protrusion 240, the protrusion base 241 traverses the positioning channel slot 220 of the companion plate 200.

For example, users slideably locking two plates 200 together may notice a slight increase in translational resistance as the positioning protrusion head 242 makes contact with the locking dimple 250 of the companion plate 200, and a decrease in translational resistance as the positioning protrusion head 242 moves past the locking dimple 250 of the companion plate 200. This drop in translational resistance provides users tactile feedback that the positioning protrusion head 242 has passed the locking dimple 250 and the positioning protrusion 240 is fully seated in circumferential plate first opening 225.

Additionally, users slideably unlocking two plates 200 may also observe a slight increase and then decrease in translational resistance as the positioning protrusion head 242 makes contact with the locking dimple 250 of the companion plate 200 and then moves away from the locking dimple 250 and into the plate rim slot 221 of the companion plate 200.

As shown at least in FIG. 4A thru 4G, in an exemplary preferred embodiment the mateable plate apparatus comprises: a first plate 200 and an identical companion plate 200, each plate including: a circumferential rim portion 205 forming an opening, the rim portion comprising at least one positioning channel 220, the circumferential plate rim further comprising a top surface 206 and a bottom surface 207, the circumferential plate rim 205 further comprising a plate side wall 210 extending from the plate rim 205, the circumferential plate rim 205 further comprising a plate bottom 215 forming an enclosure of the side wall 210; wherein the positioning channel 220 includes a slot 221, a first opening 225 provided at a proximal end of the slot 221, and a second opening 230 provided at a distal end of the slot 221, wherein the slot 221 interconnects the first opening 225 and the second opening 230, and wherein the at least one positioning channel 220 extends completely through both the circumferential rim top surface 206 and the circumferential rim bottom surface 207; a positioning protrusion 240 is provided on the plate rim top surface 206; wherein the positioning protrusion 240 of the first plate 200 is sized to be positioned in the at least one positioning channel 220 of the companion plate 200 when the plates are mated together and turned or translated into a locked position; wherein each plate 200 includes a locking dimple 250 provided on the circumferential rim bottom surface 207 approximate the circumferential plate first opening 225, and wherein the positioning protrusion 240 is positioned in the first opening 225 and abuts the locking dimple 250 to hold the plates 200 together when the plates 200 are turned or translated into a locked position.

Forming the Mated Apparatus

As indicated above the mateable plate apparatus 100 of the instant invention is formed by interlocking a pair of identical plates 200 having complimentarily and lockingly mateable features.

The positioning protrusion 240 of a first plate 200 is inserted into the plate rim second opening 230 of an identical companion plate 200 so that the positioning protrusion head 242 of the first plate 200 passes thru the plate rim second opening 230 of the identical companion plate 200.

The protrusion base 241 of the first plate 200 is then translated along the positioning channel slot 220 of the companion plate 200 until the positioning protrusion head 242 of the first plate 200 encounters the locking dimple 250 of the companion plate 200.

As the protrusion base 241 of the first plate 200 is further translated, there is a slight increase and then decrease in the translational resistance as the positioning protrusion head 242 makes contact with the locking dimple 250 of the companion plate 200 and then moves past the locking dimple 250.

The decrease in the translational resistance may provide tactile feedback that the protrusion base 241 of the first plate 200 is either fully seated within the first opening 225 of the companion plate 200 or that the protrusion base 241 of the first plate 200 is positioned within the positioning channel slot 220 of the companion plate 200.

Where the positioning protrusion head 242 of the first plate 200 is slightly larger than the positioning channel slot 220 and/or the positioning channel first opening 225 of the companion plate 200, the first plate 200 is prevented from separating from the companion plate 200.

It is understood that the protrusion base 241 of the first plate 200 may be sized to provide minimal to large tactile feedback as it traverses the positioning channel slot 220 of the companion plate 200 and less or no tactile feedback once the protrusion base 241 is within the circumferential plate first opening 225 of the first plate 200.

It is further understood the that the protrusion base 241 of the first plate 200 may be sized to provide minimal to no tactile feedback as it traverses the positioning channel slot 220 of the companion plate 200 and more or no tactile feedback once the protrusion base 241 is within the circumferential plate first opening 225 of the first plate 200.

In other words, the user may feel a bit of resistance as the plates 200 are being locked together and then a drop in resistance once the plates 200 are in a locked together position—or alternatively, the users may feel no resistance as the plates 200 are being locked together and then possibly an increase in resistance once the plates 200 are locked together due, for example to the size of the positioning channel slot 220 on the companion plate 200, the size of the plate first opening 225 on the companion plate 200, the locking dimple 250 of the companion plate 200, the size of the protrusion base 241 of the first plate, or due to the protrusion base 241 of the first plate making contact with the first opening 225 on the companion plate 200.

Plate Flipping

The instant invention provides usefulness in that, among other things, users can merely flip one plate 200 over and use it as a securable top for a companion plate 200 thereby forming a securable receptacle 100. This flip-the-top plate functionality makes the instant invention a multifunctional apparatus for users.

After flipping one plate 200 onto a companion plate 200, users can form a securely locked receptacle by rotating either or both plates 200 until the protrusion base 241 of one plate makes contact with the first opening 225 on the companion plate 200. The reverse procedures are used to unlock or unsecure the interface between one plate 200 and the companion plate 200.

Plate Stacking

Figure 4A:
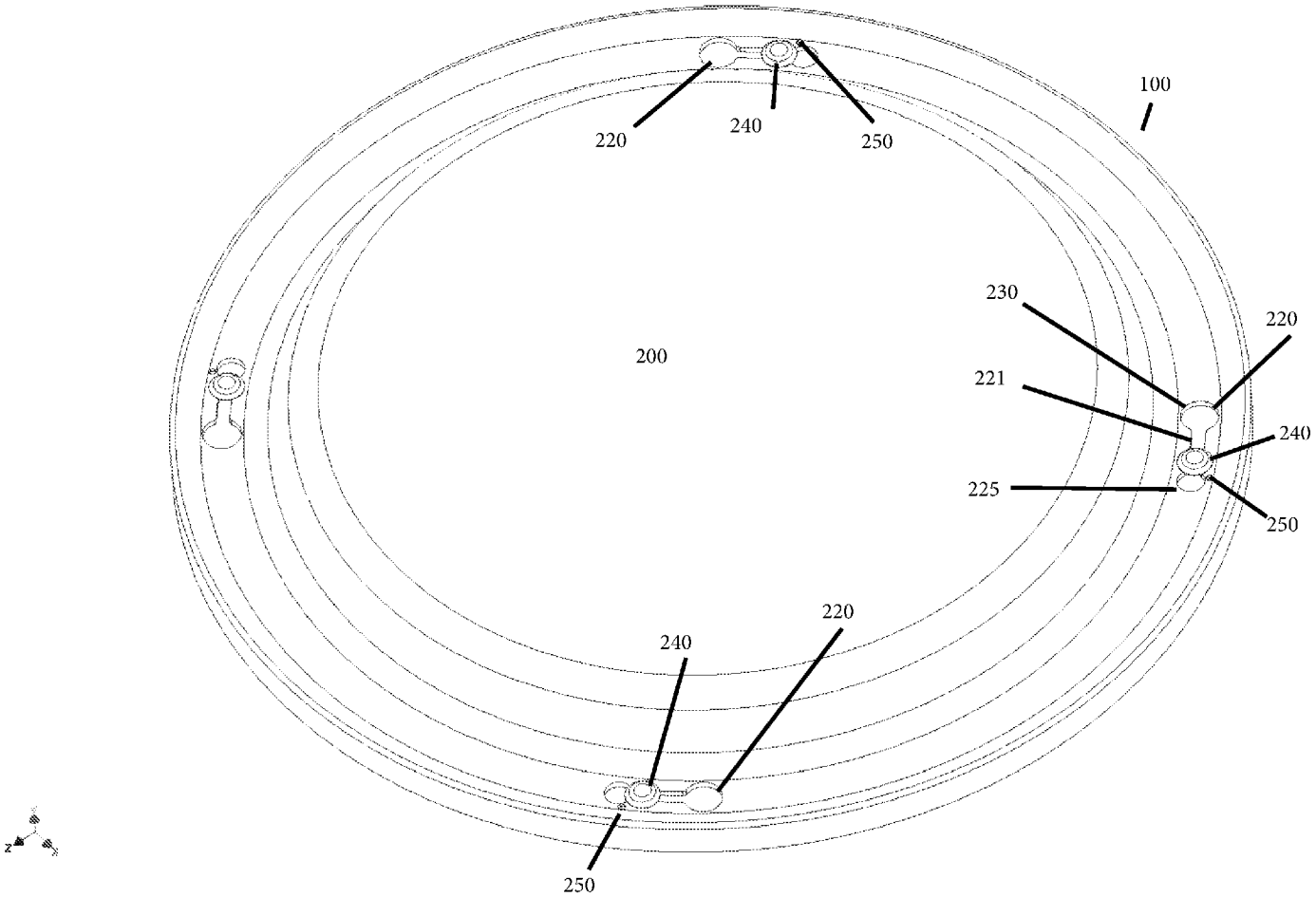
FIG. 4A is a perspective view of a plate having a protrusion, slot, and dimple.
Figure 4B:
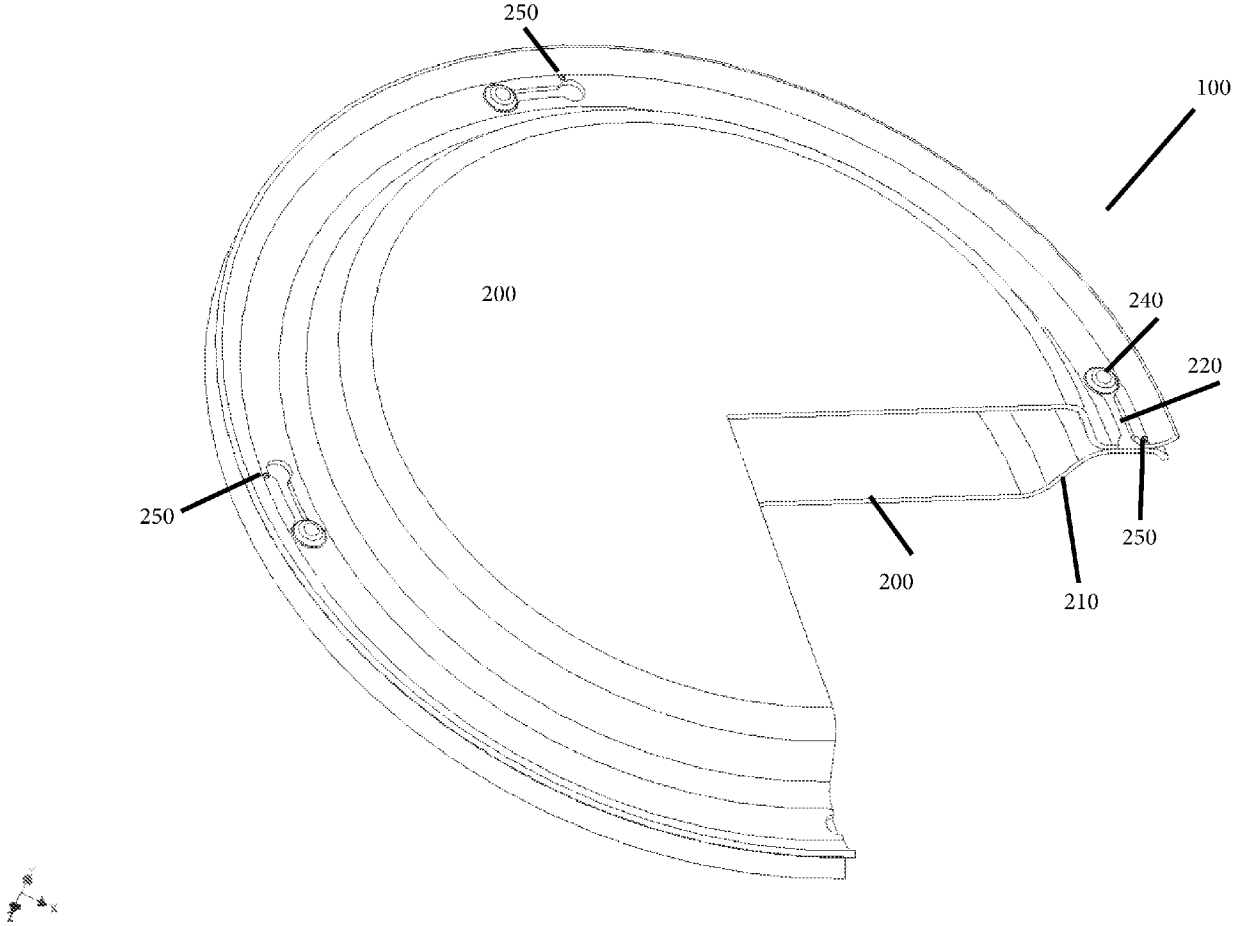
FIG. 4B is a perspective view of a plate having a protrusion, slot, and dimple.
Figure 4C:
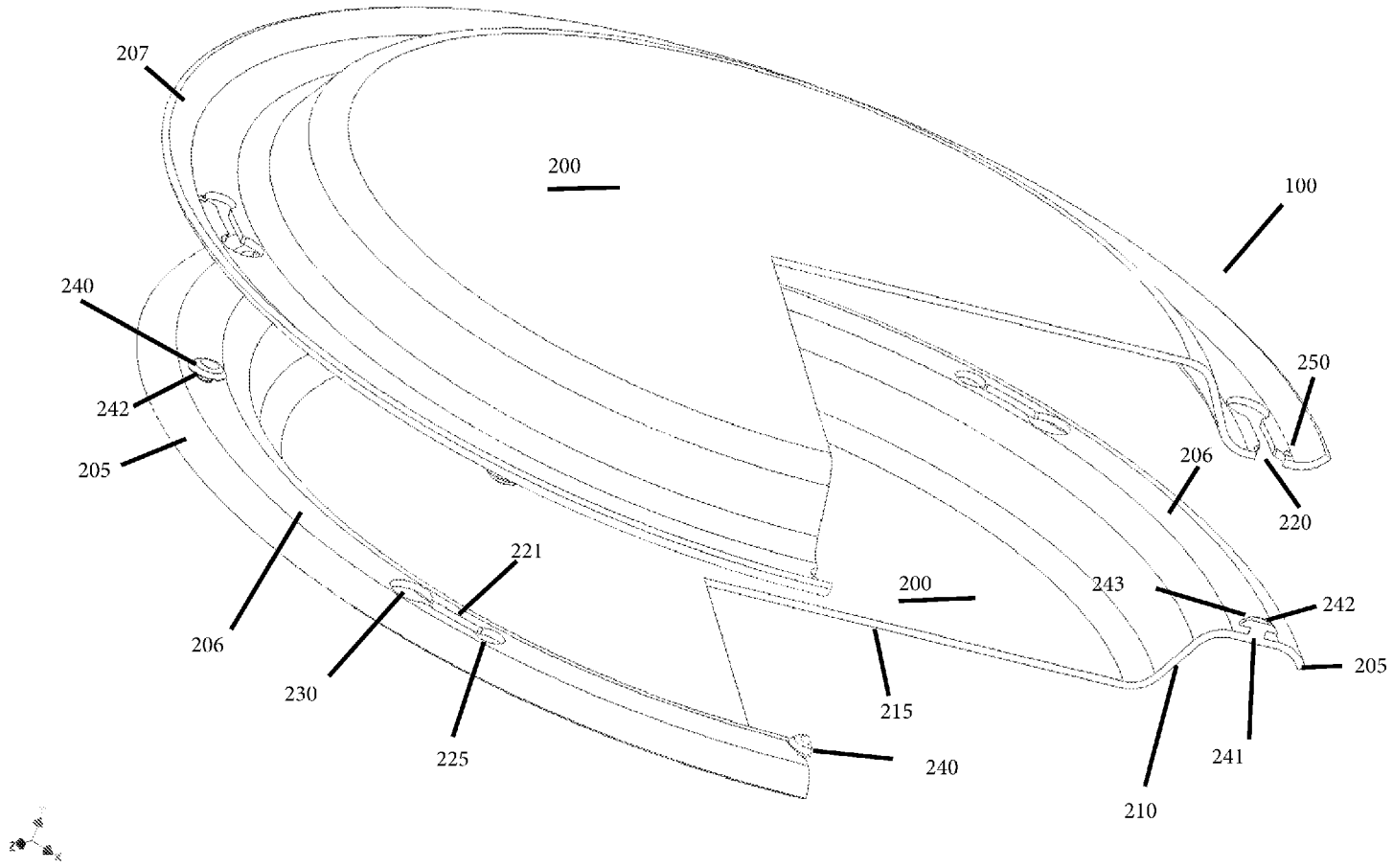
FIG. 4C is a perspective view of a plate having a protrusion, slot, and dimple.
Figure 4D:
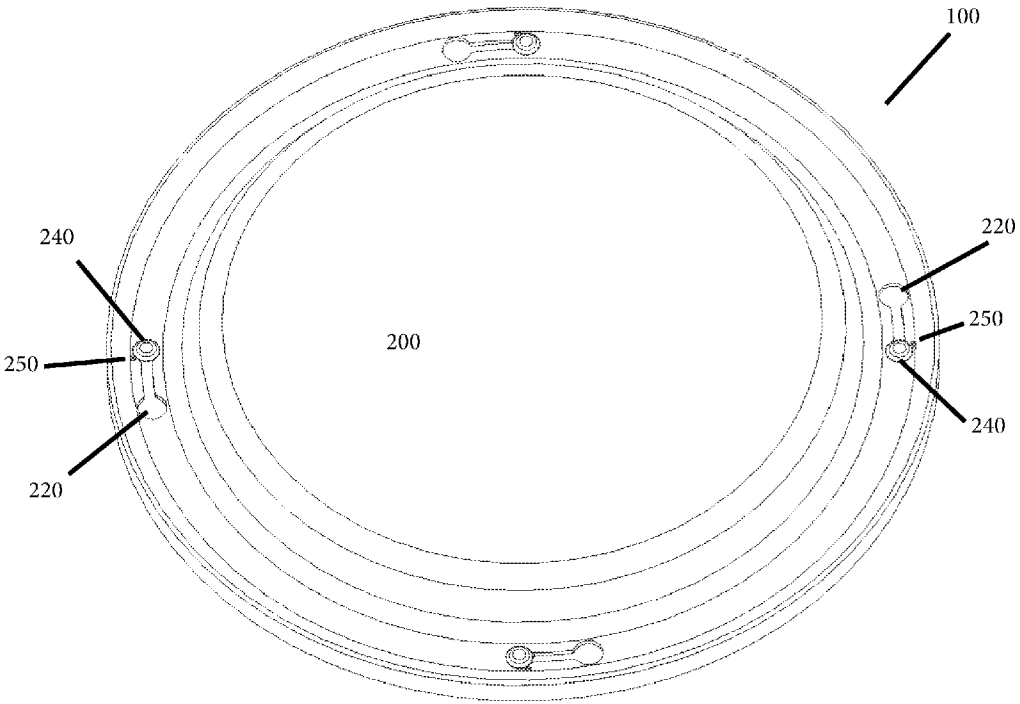
FIG. 4D is a perspective view of a plate having a protrusion, slot, and dimple.
Figure 4E:
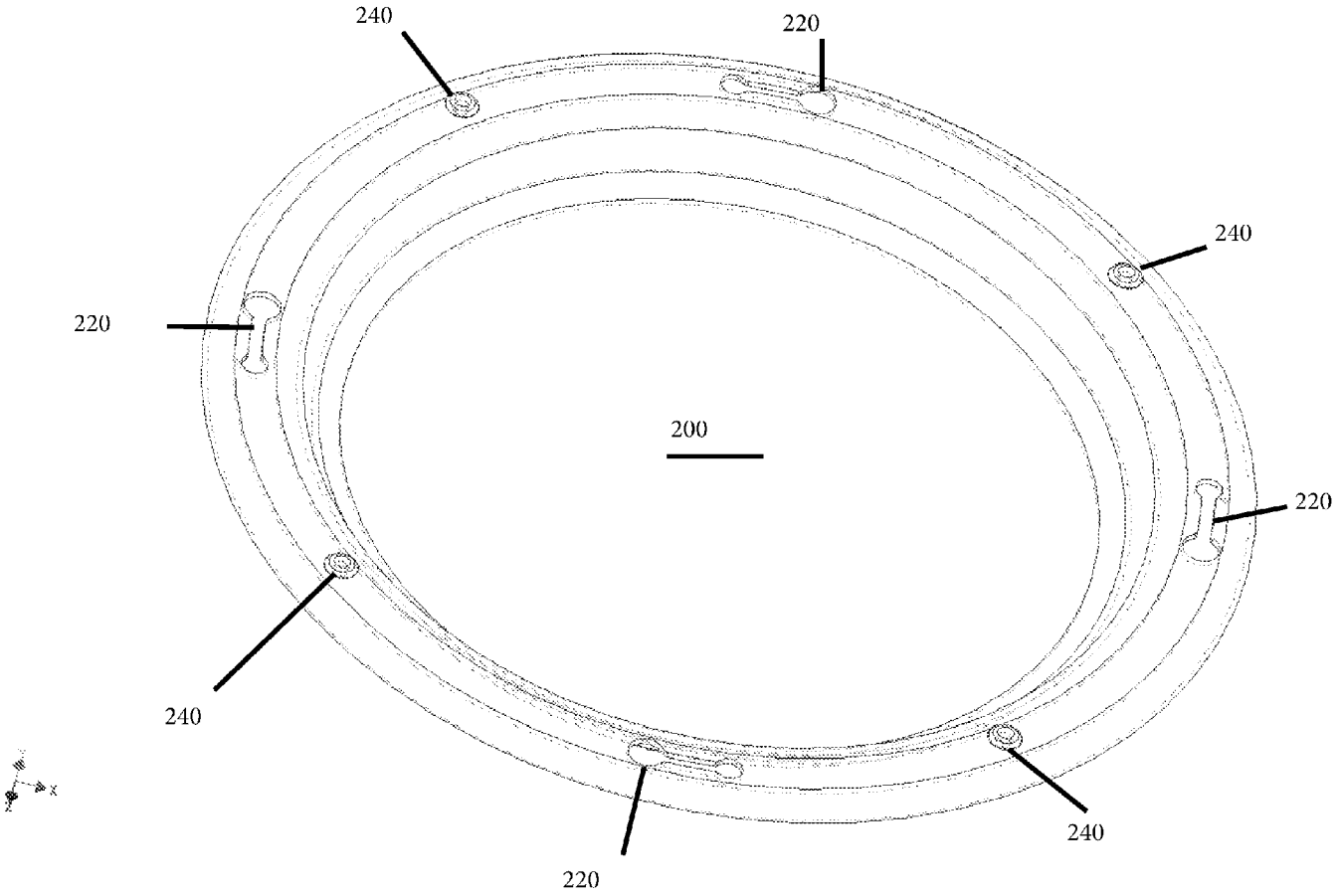
FIG. 4E is a perspective view of a plate having a protrusion, slot, and dimple.
Figure 4F:
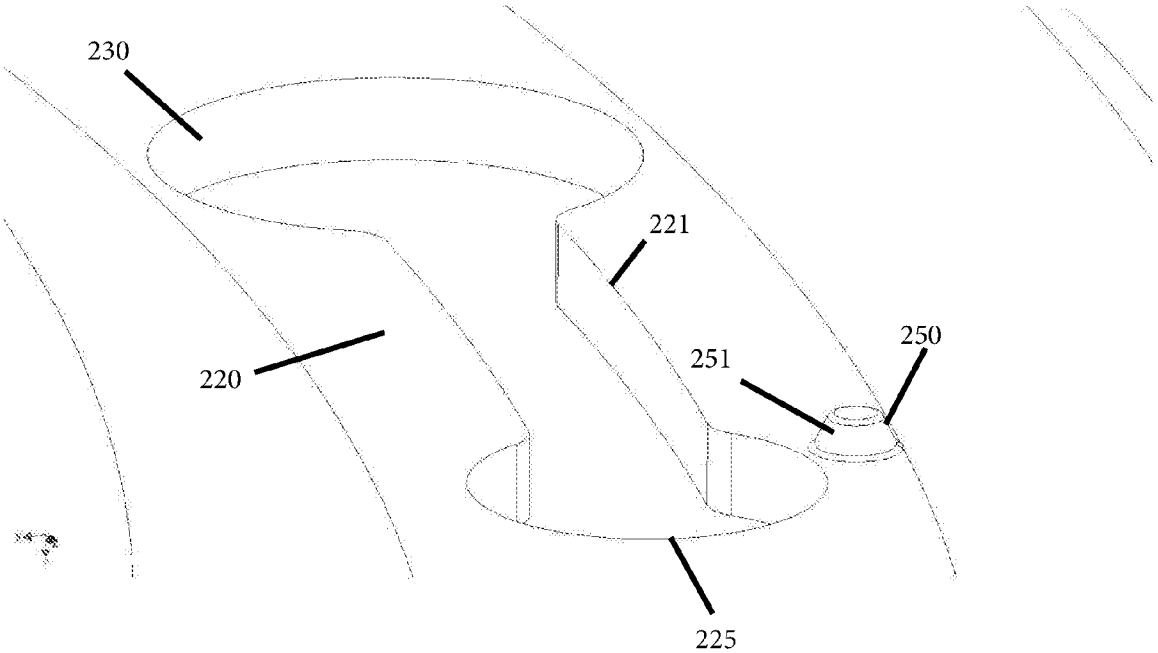
FIG. 4F is a perspective view of a plate apparatus having a protrusion, slot, and dimple.
Figure 4G:
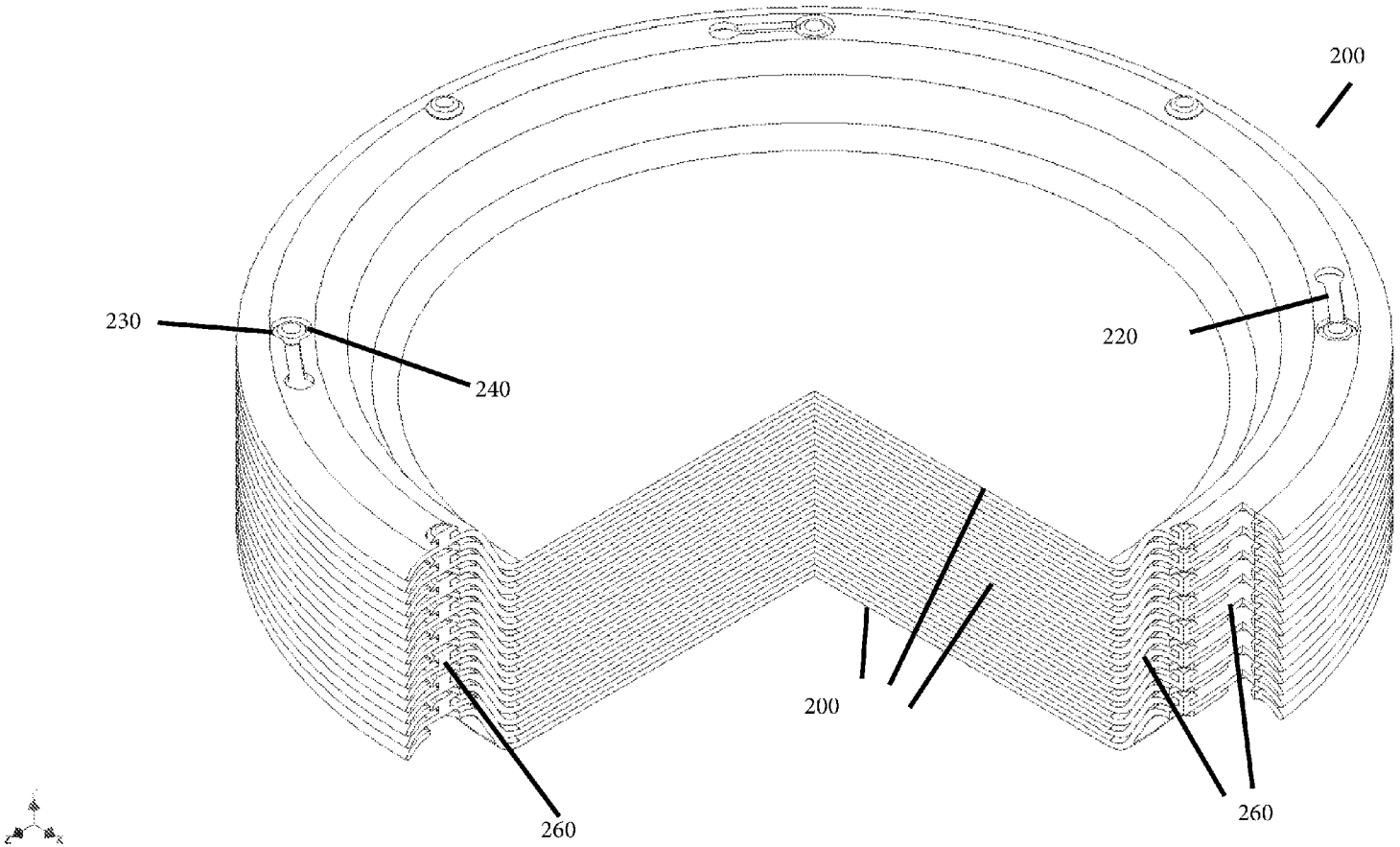
FIG. 4G is a perspective view of stacked plates.

FIG. 4G discloses a stack of interlocking identical plates 200 having complimentarily and lockingly mateable features.

For plate stacking of at least one plate 200 atop a similarly oriented companion plate 200, the circumferential plate rim 205, plate side wall 210, plate bottom 215, positioning channel 220, positioning protrusion 240, and the locking dimple 250 of each plate 200 are sized to optimize stacking space. Stacking space is optimized where the instant invention presents minimal points of contact between one plate 200 and the companion plate 200.

Further within the instant invention, stacking space can be optimized where a stack of plates 200 forms a fluid channel or passageway between the top surface 206 and a bottom surface 207 of consecutive plates 200. This passageway 260 can be sized to achieve the optimum flow (free or constrained) of fluids such as air, water, or any material solutions including gasses, vapors, steam, super-heated steam, or elements such as quantum level multiphasic particles.

In a stack of plates 200, the positioning protrusion(s) 240 of a companion plate 200 are aligned approximate the plate second opening (s) 230 of the proceeding plate 200, which enhances stacking space optimization.

Further, in the stack of plates 200, the top of the positioning protrusions 240 is positioned lower than the rim top surface 206 approximate the plate second opening (s) 230 of the proceeding plate 200, which enhances stacking space optimization.

When the plates 200 are to be separated (unstacked) the stacking space optimization features such as the fluid channel or passageway, the minimal points of contact between plates, and the compact positioning of the positioning protrusion 240 relative to the companion plate second opening 230 allow for easy separation of the plates 200 which further enhances stacking space optimization.

It is understood this inventor anticipates the instant invention can be comprised of a variety of known material including, but not limited to plastic, paper, foam, natural materials, biodegradable materials, recyclable materials, metals, liquids, and tangible compounds as well as any matter in a permanent or transitory state.

Further this inventor anticipates the instant invention can be made of clear material, opaque material, textured material, or reactive material (sensitive to chemicals, light, temperature, pressure, distance, or time).

Further this inventor anticipates the instant invention can be made into a variety of shapes beyond the shapes provided in the Figures.

The foregoing disclosure is sufficient to enable one having skill in the art to practice the apparatus without undue experimentation, and provides the best mode of practicing the apparatus presently contemplated by the inventor. While there is provided herein a full and complete disclosure of the preferred embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like. Elements of the instant apparatus may be made from a variety of known materials including wood, rubber, metal, or plastic, as well as from any suitable combination of appropriate materials.

Accordingly, the proper scope of the present apparatus should be determined only by the broadest interpretation of the appended claims so as to encompass all such modifications as well as all relationships equivalent to those illustrated in the drawings and described in the specification.

What is claimed is:

1. A mateable plate apparatus comprising:

a first plate and an identical companion plate, each including:

a circumferential rim portion forming an opening, the rim portion comprising at least one positioning channel, the circumferential plate rim further comprising a top surface and a bottom surface, the circumferential plate rim further comprising a plate side wall extending from the plate rim, the circumferential plate rim further comprising a plate bottom forming an enclosure of the side wall;

wherein the at least one positioning channel includes a slot, a first opening provided at a proximal end of the slot, and a second opening provided at a distal end of the slot, wherein the slot interconnects the first opening and the second opening, and wherein the at least one positioning channel extends completely through both the circumferential rim top surface and the circumferential rim bottom surface;

at least one positioning protrusion provided on the plate rim top surface, the positioning protrusion including a base and a head atop the base having an outer periphery;

wherein the at least one positioning protrusion of the first plate is sized to be positioned in the at least one positioning channel of the companion plate when the plates are mated together and turned or translated into a locked position;

wherein each plate includes at least one locking dimple provided on the circumferential rim bottom surface approximate the circumferential plate first opening, the locking dimple including an outer periphery, wherein during turning or translating into the locked position, the protrusion base of the first plate is translated along the positioning channel slot of the companion plate until the positioning protrusion head of the first plate encounters the locking dimple of the companion plate, and wherein there is a slight increase and then decrease in the translational resistance between the positioning protrusion head of the first plate and the locking dimple of the companion plate as the positioning protrusion head make contact with the locking dimple of the companion plate and then moves past the locking dimple, wherein the applicable at least one positioning protrusion is positioned in the first opening and the positioning protrusion head outer periphery abuts the outer periphery of the applicable locking dimple to hold the plates together when the plates are turned or translated into a locked position.

2. The mateable plate apparatus of claim 1 further comprising:

wherein the least one positioning channel includes four positioning channels positioned an equal distance apart on the circumferential rim portion and, the at least one positioning protrusion includes four positioning protrusions positioned an equal distance apart on the circumferential rim portion.

3. The mateable plate apparatus of claim 1 further comprising:

wherein when the first plate and identical companion plate are similarly oriented and stacked with the first plate atop the identical companion plate, at least one positioning protrusion of the identical companion plate seats within at least one first plate second opening.

4. The mateable plate apparatus of claim 3 further comprising:

wherein the top of the at least one positioning protrusion of the identical companion plate is positioned lower than the rim top surface of the first plate.

* * * * *